United States Patent [19]

Elter

[11] 4,223,203

[45] Sep. 16, 1980

[54] CONFORMABLE/NON-CONFORMABLE ROLL FUSER

[75] Inventor: John F. Elter, Fairport, N.Y.

[73] Assignee: Xerox Corporation, Stamford, Conn.

[21] Appl. No.: 944,945

[22] Filed: Sep. 22, 1978

[51] Int. Cl.[3] ..... H05B 1/00; G03G 15/20

[52] U.S. Cl. ..... 219/216; 219/388; 219/469; 432/60; 432/228

[58] Field of Search ..... 219/216, 388 W, 465–471; 355/3 FU; 432/60, 228

[56] References Cited

U.S. PATENT DOCUMENTS

| | | | |
|---|---|---|---|
| 3,809,854 | 5/1974 | Sanders | 219/216 |
| 3,810,776 | 5/1974 | Banks et al. | 219/469 |
| 3,937,637 | 2/1976 | Moser et al. | 219/216 X |
| 3,945,726 | 3/1976 | Ito et al. | 219/216 X |
| 3,965,331 | 6/1976 | Moser et al. | 219/469 X |
| 4,019,024 | 4/1977 | Namiki | 219/216 X |
| 4,087,676 | 5/1978 | Fukase | 219/216 |

*Primary Examiner*—C. L. Albritton

[57] ABSTRACT

Heat and pressure fusing apparatus for fixing toner images to copy substrates comprising a first fusing system consisting of a pair of nip forming rolls, one of which is provided with a conformable outer surface and a second fusing system consisting of a pair of nip forming rolls, one of which has a rigid outer surface. Copy substrates are passed sequentially through the nips of the first and second fusing systems, in that order such that the toner images sequentially contact the conformable outer surface and then the rigid outer surface.

5 Claims, 2 Drawing Figures

CONFORMABLE/NON-CONFORMABLE ROLL FUSER

BACKGROUND OF THE INVENTION

This invention relates to an electrostatographic printing machine, and more particularly concerns an apparatus for fusing colored images.

In a typical electrostatographic printing machine, a latent image is recorded on a surface and developed with charged particles. After the latent image is developed, a sheet of support material is positioned closely adjacent thereto so as to receive the particles therefrom. The particles are then permanently affixed to the sheet of support material forming a copy of the original document thereon. Electrographic and electrophotographic printing are differing versions of electrostatographic printing. The process of electrophotographic printing employs a photoconductive member arranged to be charged to a substantially uniform level. The charged photoconductive member is exposed to a light image of an original document. The light image irradiates the charged photoconductive member dissipating the charge in accordance with the intensity of the light transmitted thereto. This records an electrostatic latent image on the photoconductive surface. Electrographic printing differs from electrophotographic printing in that neither a photoconductive member nor a light image of the original document are required to create a latent image on the surface. Both of the foregoing processes generally employ heat settable particles to develop the latent image. The particles are commonly fused to the sheet of support material by the application of heat and pressure thereto.

Various techniques have been developed for applying heat to the particles on the sheet of support material. One technique is to pass the sheet of support material with the powder image thereon through a pair of opposed rollers. In one such system, a heated fuser roll and a non-heated backup roll are employed.

In the most commonly employed type of heated roll fuser, the heated fuser roll has the outer surface thereof covered with a polytetrafluoroethylene commonly known as Teflon to which a release agent such as silicone oil is applied. The Teflon layer, preferably, has a thickness of about several mils.

More recently fuser systems have been utilizing silicone rubber fuser rolls for contacting the toner images to thereby enhance copy quality, that is to say, perceived copy quality.

Bare roll fusers while not commercially accepted have been making inroads, at least in the patent literature. Heretofore, however, no single contact fusing device has been developed which satisfactorily fuses colored toner images. This is because none of the aforementioned fusers can singly fulfill all of the requirements to yield acceptable copy quality.

The requirements for acceptable copy quality are as follows: 1. adequate fix (i.e. toner coalescence and adherence to the paper); 2. adequate fuse level (i.e. toner rendered sufficiently transparent to allow substractive color reproduction to occur); 3. maximum color saturation (i.e. halftone dot spreading at moderate area coverages, 20–90%); 4. minimization of noise in low coverage (5–20%) highlight regions (i.e. dot spreading minimization for background and granularity enhancement) and 5. uniform image gloss independent of pile height (i.e. final image surface must be smooth to minimize de-saturation due to light scattering).

In addition to the failure of known roll fusers to singly satisfy all of the foregoing requirements other systems such as radiant or solvent systems also fall short of being acceptable. For example, in the case of a single step non-image contacting fuser (i.e. radiant or solvent), dot spreading is minimal over most of the input coverages so requirement #3 is not satisfied.

Furthermore, such sytems violate requirement #5. In this regard it can be shown, for examle, that conventional non-contacting systems will inherently deliver a pile height dependent gloss. If the toner has a viscosity of $4.35\times10^3$ poise, for example, it can be shown that the time it takes for an initial toner surface non-uniformity (with characteristic wavelength of 50 microns) to decrease to $e^{-1}$ of its initial value depends upon the pile height as follows:

| HEIGHT (MICRONS) | TIME (SECS.) |
|---|---|
| 6.4 | 1.4 |
| 5.0 | 2.1 |
| 3.0 | 7.2 |
| 1.0 | 4.2 |

Consequently, in any practical system a single step non-contacting system will deliver an image gloss which is pile height dependent, thus violating requirement #5.

Consider next the case of a single step non-conformable fuser. With conventional toners these systems can satisfy all of the requirements except #4. Dot spreading depends upon the characteristic parameter $$\frac{\hat{P}_o^{\frac{1}{\eta}}\, t}{\gamma(T)} \tag{1}$$

where $\hat{P}_o$ is the pressure on the halftone dot, t is the dwell time and $\tau(T)$ is a temperature dependent viscosity like parameter. The factor n accounts for the non-Newtonian flow behavior of the toner. For most toner materials $n \doteq 0.6$. In the non-conformable system, the image $P_o$ can greatly exceed the average nip pressure, $\bar{p}$. In the case of a perfectly smooth and rigid paper support, $$\hat{P}_o = \bar{P}/C_A \tag{2}$$

where $C_A$ is the fractional area coverage. Accordingly, single-step non-conformable fusers have their greatest dot-squashing effect in the low coverage, highlight regions. Such systems therefore tend to amplify any non-uniformity in the unfused halftone dot pattern, thus violating requirement #4.

Note, however, that equation (2) indicates that at moderate coverages (30–90%) the image pressure is not drastically different from the nip pressure, so non-conformable systems can operate without excessive noise amplification in this region.

Finally, consider the case of a single step conformable fuser. In this case the image pressure is nearly equal to the nip pressure so the term $P^{1/n}t/\tau(T)$ can be made small enough so that minimum dot squashing occurs at the lower coverages while simultaneously achieving dot spreading in the mid coverage range. Single step conformable contact fusers can therefore satisfy requirements #1, #2, #3 and #4, and this has been experimentally verified. However, experimentally it can be shown that the energy (energy delivered to the toner layer) required to achieve a sufficiently high gloss is nearly twice the value needed in the non-conformable bare metal roll fuser. This evidence indicates that the "fusing" step (requirement #2) and the "glossing" step (requirement #5) are independent and are peculiar to the inherent fusing technique. In addition, single step conformable systems violate the second part of requirement #5 in that the fused halftone image is not smooth, since the conformble system can accommodate the micro-structure of the dot shape.

In order to satisfy all of the requirements listed above, this invention suggests a generic fusing system wherein the "fusing" and "glossing" steps are separated.

BRIEF SUMMARY OF THE INVENTION AND PRIOR ART

Improved colored image fusing is accomplished by the provision of a conformable contact fusing system through which the copy substrates pass and a non-conformable contact glossing system through which the substrates pass after having gone through the first system.

The conformable contact fusing system comprises a silicone rubber fuser roll while the non-conformable contacting system comprises a bare metal or other comparably rigid surfaced roll.

"Two stage" fusing is known. For example, U.S. Pat. No. 3,861,863 discloses a black and white image fuser comprising a first stage backside heater and a second stage soft roll fuser. U.S. Pat. No. 3,679,302 discloses first and second stage radiant fusers. U.S. Pat. No. 3,566,076 discloses the combination of radiant and pressure fusing. However, it is believed that none of these fusing systems meet all of the requirements for fusing colored images.

DETAILED DESCRIPTION OF THE PREFERRED EMBODIMENT

Figure 1:
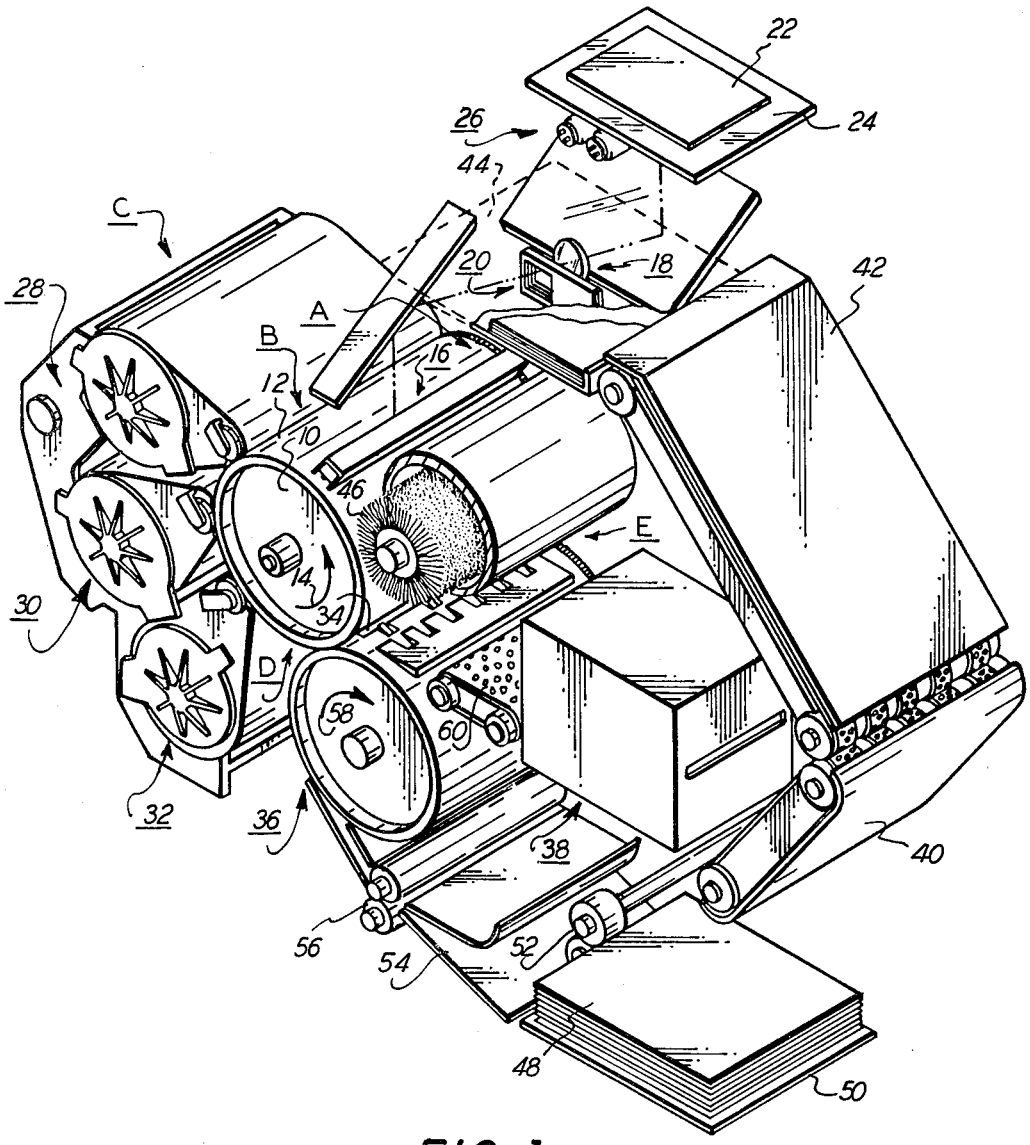
FIG. 1 is a perspective view of an electrophotographic printing machine having the present invention incorporated therein.

FIG. 1 schematically illustrates an electrophotographic printing machine arranged to produce multicolor copies from a color original. As shown therein the machine employs a photoconductive member having a rotatably mounted drum 10 with a photoconductive surface 12 thereon. Drum 10 rotates in the direction indicated by arrow 14 to move photoconductive surface 12 through a series of processing stations A through E, inclusive.

Initially, drum 10 rotates photoconductive surface 12 through charging station A which has a corona generating device, indicated generally by the reference numeral 16, positioned thereat. Preferably, corona generating device 16 extends transversely across photoconductive surface 12 and is arranged to charge surface 12 to a relatively high uniform potential. A suitable corona generating device is described in U.S. Pat. No. 2,778,946 issued to Mayo in 1957.

Charged photoconductive surface 12 next rotates to exposure station B wherein a moving lens system indicated generally at 18, and a color filter mechanism, depicted generally at 20, are positioned. One type of moving lens system suitable for the electrophotographic printing machine of FIG. 1 is disclosed in U.S. Pat. No. 3,062,108 issued to Mayo in 1962. As illustrated in FIG. 1, a colored original document 22 is stationarily supported face down upon transparent viewing platen 24. In this manner, successive incremental areas of original document 22 are illuminated by a moving lamp assembly, indicated generally at 26. Lamp assembly 26 and lens system 18 are moved in a timed relation with drum 10 to produce a flowing light image of original document 22 on photoconductive surface 12. The resultant image produced on photoconductive surface 12 is termed an electrostatic latent image. The electrophotographic printing machine depicted in FIG. 1 is arranged to interpose selected colored filters in the optical path of lens 18 via filter mechanism 20. Preferably, filter mechanism 20 operates on the light rays transmitted through lens 18 to record an electrostatic latent image on photoconductive surface 12 corresponding to a preselected spectral region of the electromagnetic wave spectrum, i.e. a color separated electrostatic latent image. In this manner, an electrostatic latent image is produced on photoconductive surface 12 which corresponds to a single color of original document 22.

Subsequent to the recording of the color separated electrostatic latent image on photoconductive surface 12, drum 10 rotates to development station C having three individual developer units, generally indicated by the reference numerals 28, 30 and 32, respectively, located thereat. The developer units depicted in FIG. 1 are all magnetic brush type developer units. In a magnetic brush development system, a magnetizable developer mix having carrier granules and toner particles is continually brought through a directional flux field to form a brush of developer mix. A suitable development system utilizing a plurality of developer units is disclosed in U.S. Pat. No. 3,854,449 issued to Davidson in 1974. Development is achieved by contacting photoconductive surface 12 with the brush of developer mix. Developer units 28, 30 and 32, each apply toner particles corresponding to the complement of the color separated latent image recorded on photoconductive surface 12. For example, developer units 28 deposits cyan toner particles on a red filtered latent image, developer unit 30 deposits magenta toner particles on a green filtered latent image, and developer unit 32 deposits yellow toner particles on a blue filtered latent image. The aforementioned steps of depositing various color toner particles on the respective electrostatic latent images occurs sequentially rather than simultaneously.

After development, the toner powder image electrostatically adheres to photoconductive surface 12 and moves therewith to transfer station D. At transfer station D the powder image is transferred to a sheet of final support material 34 by means of a biased transfer roll, shown generally at 36. U.S. Pat. No. 3,612,677 issued to Langdon in 1972 discloses a suitable electrically biased transfer roll. Transfer roll 36 is biased electrically to a potential such that the magnitude and polarity thereof is sufficient to attract electrostatically the toner powder image from photoconductive surface 12 to support material 34. A single sheet of support material 34 is supported on transfer roll 36. Bias transfer roll 36 is arranged to recirculate the sheet of support material 34 in synchronism with the rotation of drum 10. In this manner, the toner powder images developed on photoconductive surface 12 are transferred, in superimposed registration, to sheet 34. Hence, it is apparent that in a multi-color electrophotographic printing of the type depicted in FIG. 1, the aforementioned steps of charging, exposing, developing and transfer are repeated for a plurality of color separated light images in order to form a composite picture of the original document corresponding in color thereto.

After the last transfer operation, support sheet 34 is stripped from bias transfer roll 36. Conveyor 60 advances sheet 34 to a fuser apparatus shown generally at 38, where the multi-layered toner powder image is coalesced and permanently affixed thereto. Fuser 38 will be discussed hereinafter in conjunction with FIG. 2 in greater detail. After the multi-layered toner powder image is coalesced to support material 34, endless conveyor belts 40 and 42 advance support material 34 to catch tray 44 for subsequent removal by the machine operator.

Cleaning station E is the last processing station in the direction of rotation of drum 10, as indicated by arrow 14. Cleaning station E has positioned thereat a rotatably mounted fibrous brush 46 which engages photoconductive surface 12 to remove residual toner particles remaining thereon after the transfer operation. Preferably, fibrous brush 46 is of the type described in U.S. Pat. No. 3,590,412 issued to Gerbasi in 1971.

It should be noted that support material 34 may be plain paper or a transparent thermoplastic sheet, amongst others, which is advanced from a stack 48 mounted on tray 50. Feed roll 52 separates and advances the uppermost sheet from stack 50 into a baffle arrangement 54. Baffle 54 guides the advancing sheet into the nip of a pair of register rolls which align the sheet and pass it therebetween such that it is releasably secured to bias transfer roll 36. Bias transfer roll 36 is arranged to rotate in the direction of arrow 58 moving support material 34, releasably secured thereto, in a recirculating path such that successive toner images are transferred thereto in superimposed registration with one another forming a multi-layered toner powder image.

Figure 2:
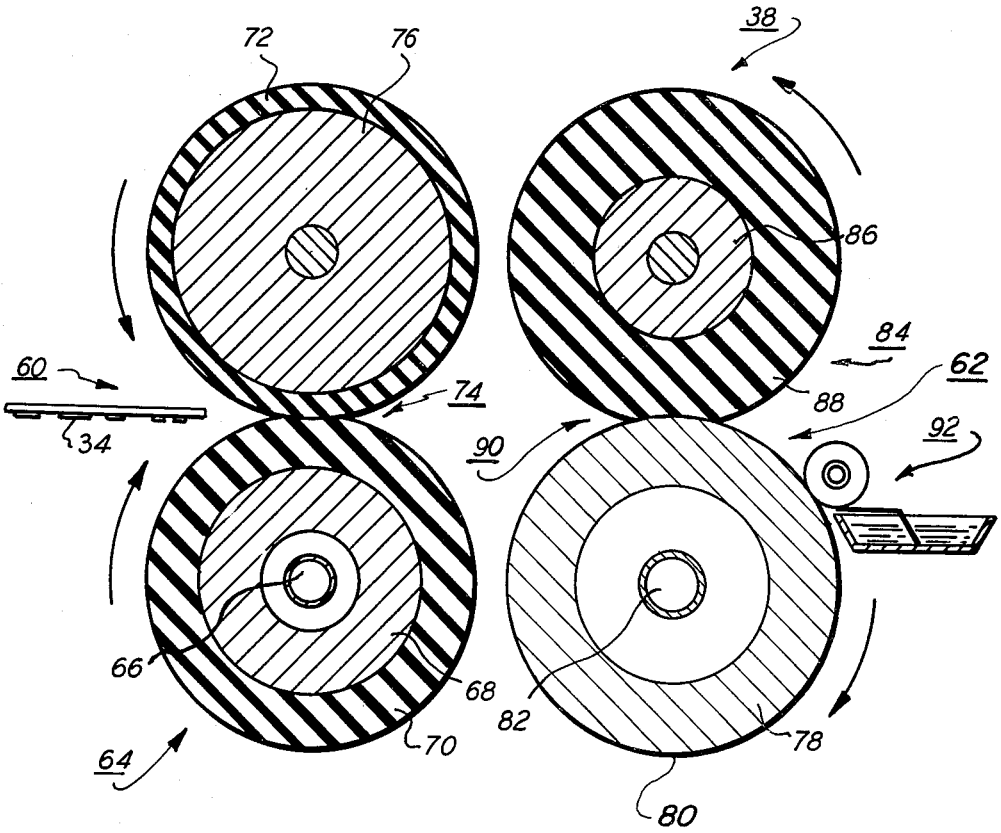
FIG. 2 is a schematic view of a fusing apparatus representing the invention.

Referring now to FIG. 2, there is shown a side elevational view, schematically depicted, of the fuser utilized in the electrophotographic printing machine of FIG. 1. As illustrated the fuser comprises a first roll fusing system 60 and a second roll fuser system 62 through which the support material 34 having the toner images thereon is sequentially moved, first through the system 60. After the multi-layered toner image is fixed to the support material 34, endless conveyor belts 40 and 42 advance the support material to catch tray 44 for subsequent removal by the machine operator.

The fusing system 60 comprises a fuser roll structure 64 having an internally supported radiant heat source 66 disposed within a hollow, rigid cylinder 68, which is preferably metal. Adhered to the outer surface of the cylinder 68 is a layer of silicone rubber 70 which is deformable by a much harder surfaced backup roll 72 to form a nip 74 through which the support material 34 passes with the toner images contacting the silicone rubber. In a well known manner, silicone oil may be applied to the surface of the silicone rubber in order to enhance release of the material 34 from the fuser roll with a minimum of toner offsetting thereto. The backup roll 72 comprises a rigid, thermally conductive core 76 coated with a thin layer of Teflon, trademark of E. I. duPont. The layer 70 may also comprise Viton (trademark of E. I. duPont) or other suitable materials. It may be discernible and quite acceptable to have the Viton layer applied as a thin layer with the backup roll being deformable by the fuser roll.

The second fusing system comprises an internally heated fuser roll 78 comprising a thermally conductive cylinder 80 having a heat source 82 disposed in the hollow thereof, the length of the heat source being substantially coextensive with the length of the cylinder 80. The fuser roll 78 cooperates with a deformable backup roll 84 comprising a rigid metal core 86 having a relatively thick deformable layer 88 affixed thereto, to form a nip 90 through which the support material 34 passes with the toner images contacting the surface of the metal fuser roll 78.

The surface of the fuser roll 78 is coated with functional silicone oil (i.e. silicone oil containing material capable of interacting with the metal roll surface) whereby a toner impenetrable layer is formed at the surface of the roll. The silicone oil is applied by a metering system generally indicated at 92.

What is claimed is:

1. Roll fuser apparatus for fixing toner images to copy substrates utilizing first and second fusing systems through which the substrates pass in series with transport means for reeding the substrates to the first fuser, the improvement comprising: a conformable contact fusing system including a conformable roll which contacts said toner images, said conformable contact fusing system constituting one of said fusing systems and a non-conformable contact fusing system including a non-conformable roll which contacts said toner images and comprises the other of said fusing system.

2. Apparatus according to claim 1 wherein said conformable contact fusing system comprises a roll pair one of which has an elastomeric layer as its outer surface which forms a nip, with the other roll through which said substrates first pass with said toner images contacting said elastomeric layer.

3. Apparatus according to claim 2 wherein said non-conformable contact fusing system comprises a pair of rolls forming a nip, wherein one of the rolls consists of a bare metal roll coated by a release surface and the toner images contact the bare metal roll coated by said release surface as the substrates pass through said nip.

4. Apparatus according to claim 3 wherein said elastomeric layer comprises silicone rubber.

5. Apparatus according to claim 4 wherein said release surface is formed by the interaction of functional silicone oil and the surface of the bare metal roll.

* * * * *